US009525234B2

(12) United States Patent
Ono

(10) Patent No.: US 9,525,234 B2
(45) Date of Patent: Dec. 20, 2016

(54) ELECTRICAL CONDUCTOR

(71) Applicant: SMK Corporation, Tokyo (JP)

(72) Inventor: Naoyuki Ono, Tokyo (JP)

(73) Assignee: SMK Corporation, Tokyo (JP)

( * ) Notice: Subject to any disclaimer, the term of this patent is extended or adjusted under 35 U.S.C. 154(b) by 15 days.

(21) Appl. No.: 14/651,102

(22) PCT Filed: Sep. 25, 2014

(86) PCT No.: PCT/JP2014/075497

§ 371 (c)(1),
(2) Date: Jun. 10, 2015

(87) PCT Pub. No.: WO2016/021083

PCT Pub. Date: Feb. 11, 2016

(65) Prior Publication Data

US 2016/0285191 A1 Sep. 29, 2016

(30) Foreign Application Priority Data

Aug. 8, 2014 (JP) ..... 2014-162187

(51) Int. Cl.
*H01R 24/00* (2011.01)
*H01R 13/50* (2006.01)
(Continued)

(52) U.S. Cl.
CPC ..... *H01R 13/50* (2013.01); *H01R 13/6594* (2013.01); *H01R 13/405* (2013.01); *H01R 23/02* (2013.01); *H01R 24/60* (2013.01)

(58) Field of Classification Search
USPC ..... 439/660
See application file for complete search history.

(56) References Cited

U.S. PATENT DOCUMENTS 4,530,557 A * 7/1985 Katsube. ..... H01R 13/405 439/325
5,902,154 A * 5/1999 Nakata ..... H01R 12/727 439/660

(Continued)

FOREIGN PATENT DOCUMENTS

JP 2006-202656 A 8/2006
JP 2012-146419 A 8/2012

(Continued)

OTHER PUBLICATIONS

International Search Report issued in corresponding PCT Application No. PCT/JP2014/075497 mailed Dec. 16, 2014 (2 pages).

(Continued)

*Primary Examiner* — Tho D Ta
(74) *Attorney, Agent, or Firm* — Osha Liang LLP

(57) ABSTRACT

An electrical connector including a metal plate including an insulating portion and an insulating portion; and a contact support portion including a hole portion that is extended in a thickness direction, of which a top end is blocked by a connection portion, and of which a bottom end exposes the insulating portion but not the metal plate, and a hole portion that is extended in the thickness direction, of which a bottom end opens to an outer surface and is blocked by a connection portion, and of which a top end exposes the insulating portion but not the metal plate.

8 Claims, 6 Drawing Sheets

(51) Int. Cl.

| | |
|---|---|
| ***H01R 13/6594*** | (2011.01) |
| *H01R 13/405* | (2006.01) |
| *H01R 24/60* | (2011.01) |

(56) References Cited

U.S. PATENT DOCUMENTS

| | | | | |
|---|---|---|---|---|
| 6,007,376 | A * | 12/1999 | Shimizu | H01R 43/0256 174/260 |
| 8,016,620 | B1 | 9/2011 | Chiu et al. | |
| 9,178,319 | B2 * | 11/2015 | Little | H01R 13/6585 |
| 9,252,542 | B2 * | 2/2016 | Little | H01R 13/6585 |
| 2009/0023338 | A1 | 1/2009 | He et al. | |

FOREIGN PATENT DOCUMENTS

| | | | |
|---|---|---|---|
| JP | 2013-114988 | A | 6/2013 |
| JP | 2014-116223 | A | 6/2014 |

OTHER PUBLICATIONS

Written Opinion issued in corresponding PCT Application No. PCT/JP2014/075497 mailed Dec. 16, 2014 (3 pages).

* cited by examiner

ELECTRICAL CONDUCTOR

CROSS-REFERENCE TO RELATED APPLICATION

The present application claims priority from Japanese Patent Application No. 2014-162187 filed on Aug. 8, 2014. The content of the priority application is hereby incorporated by reference in its entirety.

FIELD

The present invention relates to an electrical connector including an insulating housing in which a contact support portion of plate shape that supports a contact and is mated and unmated with a mating connector is included.

BACKGROUND

As a conventional electrical connector, one including an insulating housing in which a contact support portion of plate shape that supports contacts and is mated and unmated with a mating connector is included, the contacts being arranged on both top and bottom surfaces of the contact support portion for multipolarization, has been known. To reinforce the plate-shaped, low-strength contact support portion, such an electrical connector includes a metal plate held in the contact support portion (for example, Patent Literature 1).

The metal plate is buried in and fixed to the contact support portion by integral molding with the housing. Specifically, the metal plate is set in a mold and sandwiched between retaining pins from above and below so that the set metal plate is not displaced from a predetermined position by the pressure for filling a molten resin into a cavity formed between the upper and lower molds. In such a state, a molten resin is filled into the cavity. After the temperature of the resin lowers and the resin is cured, the retaining pins are removed, whereby the metal plate is fixed to the contact support portion of the housing by integral molding. The contacts then are pressed into and fixed to the housing, whereby the contacts are arranged to be exposed in part in the outer surfaces of the contact support portion of the housing.

Patent Literature 1: Japanese Patent Application Laid-Open No. 2006-202656

SUMMARY

In the conventional electrical connector, when fixing the metal plate to the contact support portion of the housing by integral molding, the metal plate needs to be sandwiched between the retaining pins from above and below. After the removal of the retaining pins, a space occurs between the metal plate fixed to the contact support portion and the contacts exposed in the surfaces of the contact support portion. If a foreign substance or liquid is interposed in this space, the electrical connector may malfunction. In particular, due to a change in the temperature of the surroundings where the electrical connector is used, moisture in the air in the space between the metal plate and the contacts can condense into droplets in the space between the metal plate and the contacts, which may cause an electrical malfunction. The distance between the metal plate and the contacts can be increased to reduce the foregoing electrical malfunction. This, however, makes the electrical connector difficult to miniaturize or densify.

One or more embodiments of the present invention provide an electrical connector that can prevent the occurrence of an electrical malfunction even if a foreign substance or liquid is interposed in the space between the metal plate and the contacts, and is capable of miniaturization and densification.

In a first aspect, an electrical connector according to the present invention includes: an insulating housing including a contact support portion of plate shape that is extended forward from a rear wall and fits to a mating connector; a conductive contact that includes a connection portion arranged on an outer surface of the contact support portion and a terminal portion connected to a conductive portion of a substrate, and is held by the housing; and a metal plate that is fixed to the contact support portion so as to be separated from the connection portion in a thickness direction of the contact support portion, wherein the metal plate includes an insulating portion at least in part, and the contact support portion includes a hole portion that is extended in the thickness direction, of which one of ends in the thickness direction is blocked by the connection portion, and of which the other end in the thickness direction exposes the insulating portion but not the metal plate.

In a second aspect, in addition to the first aspect, the electrical connector according to the present invention is configured such that: the contact includes a first contact and a second contact; the first contact includes the connection portion arranged on a first outer surface of the contact support portion; the second contact includes the connection portion arranged on a second outer surface of the contact support portion opposite from the first outer surface; the metal plate is arranged between the connection portion of the first contact and the connection portion of the second contact; and the hole portion includes a first hole portion of which one end opens to the first outer surface and is blocked by the connection portion of the first contact and of which the other end exposes the insulating portion but not the metal plate, and a second hole portion of which one end opens to the second outer surface and is blocked by the connection portion of the second contact and of which the other end exposes the insulating portion but not the metal plate.

In a third aspect, in addition to the first aspect, the electrical connector according to the present invention is configured such that: the contact includes the connection portion arranged on a first outer surface of the contact support portion; the metal plate is arranged between the first outer surface and a second outer surface of the contact support portion opposite from the first outer surface; and the one end of the hole portion opens to the first outer surface and is blocked by the connection portion, and the other end of the hole portion exposes the insulating portion but not the metal plate.

In a fourth aspect, in addition to the first aspect, the electrical connector according to the present invention is configured such that: the contact includes the connection portion arranged on a first outer surface of the contact support portion; the metal plate is arranged on a second outer surface of the contact support portion opposite from the first outer surface; and the one end of the hole portion opens to the first outer surface and is blocked by the connection portion, and the other end of the hole portion exposes the insulating portion but not the metal plate.

In a fifth aspect, in addition to any one of the first to fourth aspects, the electrical connector according to the present invention is configured such that the metal plate is entirely covered with the insulating portion.

In a sixth aspect, in addition to any one of the first to fifth aspects, the electrical connector according to the present invention is configured such that the metal plate includes a leg portion connected to a ground of the substrate and functions as a shield member.

In a seventh aspect, in addition to any one of the first to sixth aspects, the electrical connector according to the present invention is configured such that: the housing is integrally molded by filling a resin into a cavity of a mold in which the metal plate is set, whereby the metal plate is fixed to the contact support portion; and the hole portion is a trace of removal of a retaining pin for sandwiching and holding the metal plate on the mold during the integral molding.

In an eighth aspect, in addition to any one of the first to sixth aspects, the electrical connector according to the present invention is configured such that: the contact support portion includes a holding hole of which a rear end opens to outside and that is extended forward from the rear end; the metal plate is pressed into the holding hole and fixed to the contact support portion; the holding hole is a trace of a die part removed backward after filling a resin into a cavity of a mold in which the die part is set and curing the resin, the die part having the same shape as that of the metal plate; and the hole portion is a trace of removal of a retaining pin for sandwiching and holding the die part on the mold during the filling of the resin into the cavity.

The one end of the hole portion in the thickness direction is blocked by the connection portion of the contact, and the other end of the hole portion in the thickness direction exposes the insulating portion but not the metal plate. Consequently, even if moisture in the air in the hole portion of the contact support portion condenses into liquid to collect in the hole portion or a foreign substance gets into the hole portion of the contact support portion, and the distance between the metal plate and the connection portion in the hole portion is small, an electrical connection between the metal plate and the connection portion via the liquid or foreign substance is prevented.

According to the present invention, even if a foreign substance or liquid is interposed in the space between the metal plate and the contact, the occurrence of an electrical malfunction can be prevented. This also allows miniaturization and densification.

DETAILED DESCRIPTION

Figure 1:
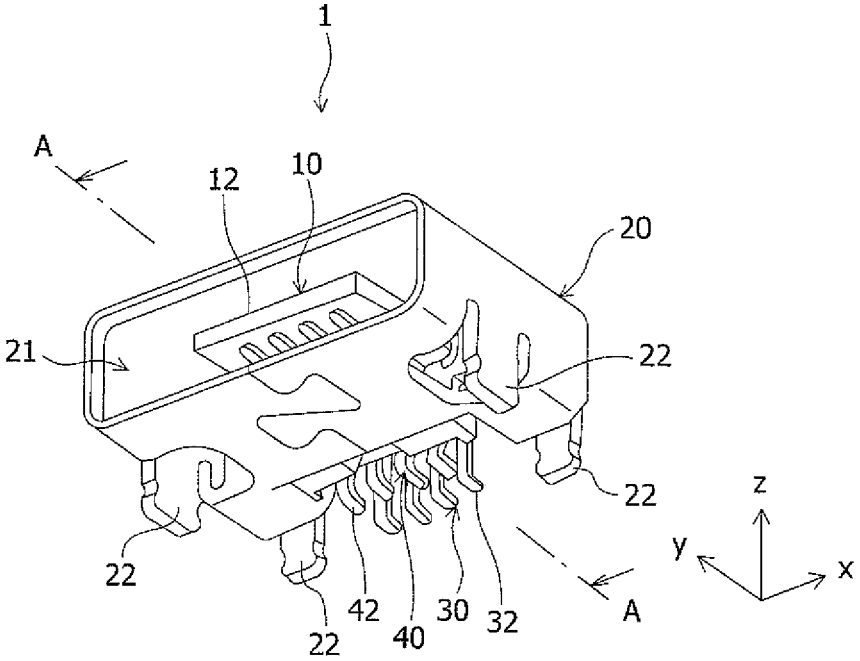
FIG. 1 is a perspective view of an electrical connector according to one or more embodiments of the present invention as seen from below, obliquely in front.

Flexible substrate-connecting connectors according to embodiments of the present invention will be described in detail below by referring to the drawings as appropriate. In the drawings, an x-axis, a y-axis, and a z-axis constitute a triaxial orthogonal coordinate system. The following description will be given with a positive direction of the y-axis as a forward direction, a negative direction of the y-axis as a backward direction, the direction of the x-axis as a horizontal direction, a positive direction of the z-axis as an upward direction, and a negative direction of the z-axis as a downward reaction.

(First Embodiment)

<Configuration of Electrical Connector>

A configuration of an electrical connector 1 according to a first embodiment of the present invention will be described in detail below with reference to FIGS. 1 and 2.

The electrical connector 1 includes a housing 10, a shield cover 20, upper contacts 30, lower contacts 40, and a metal plate 50.

The housing 10 is made of an insulating material. The housing 10 includes a plate-shaped contact support portion 12 which is extended forward from a rear wall 11. The contact support portion 12 fits to a not-shown mating connector. The contact support portion 12 includes a hole portion 13 and a hole portion 14. The hole portion 13 is extended in a vertical direction which is a thickness direction. A top end of the hole portion 13 opens to an outer surface 17 and is blocked by connection portions 31. A bottom end of the hole portion 13 exposes an insulating portion 60*a* but not the metal plate 50. The hole portion 14 is extended in the vertical direction. A bottom end of the hole portion 14 opens to an outer surface 18 and is blocked by connection portions 41. A top end of the hole portion 14 exposes an insulating portion 60*b* but not the metal plate 50. The connection portions 31 and the insulating portion 60*a* are opposed to each other via the hole portion 13. The connection portions 41 and the insulating portion 60*b* are opposed to each other via the hole portion 14.

The shield cover 20 includes an insertion hole 21 which opens to the front and into which the mating connector can be inserted, and terminal portions 22 which are connected to a ground 71 of a substrate 70. The shield cover 20 is fixed to the housing 10 by bending a metal plate material and engaging the recessed and protruded shape at one end of the plate material in the bending direction with the recessed and protruded shape at the other end.

The plurality of upper contacts 30 are made of a conductive material in a narrow plate shape each, and fixed to the housing 10. The upper contacts 30 each include a connection portion 31 and a terminal portion 32. The connection portions 31 are exposed in the outer surface 17 of the contact support portion 12 and supported by the contact support portion 12, and block the top end of the hole portion 13 opened in the outer surface 17. The terminal portions 32 are protruded outward and backward from the rear wall 11, bent downward, and connected to conductive portions 73 of the substrate 70. The connection portions 31 are arranged along the protruding direction of the contact support portion 12.

The plurality of lower contacts 40 are made of a conductive material in a narrow plate shape each, and fixed to the housing 10. The lower contacts 40 each include a connection portion 41 and a terminal portion 42. The connection portions 41 are exposed in the lower outer surface 18 of the contact support portion 12 and supported by the contact support portion 12, and block the bottom end of the hole portion 14 opened in the outer surface 18. The terminal portions 42 are protruded outward and backward from the rear wall 11, bent downward, and connected to conductive portions 72 of the substrate 70. The connection portions 41 are arranged along the protruding direction of the contact support portion 12.

The metal plate 50 is fixed to the inside of the contact support portion 12, and arranged between the upper contacts 30 and the lower contacts 40. The metal plate 50 is arranged to be separated from the upper contacts 30 and the lower contacts 40 in the thickness direction of the contact support portion 12. The metal plate 50 includes the insulating portion 60*a* which is exposed at the bottom end of the hole portion 13, and the insulating portion 60*b* which is exposed at the top end of the hole portion 14. The insulating portions 60*a* and 60*b* provided on the metal plate 50 are formed by a method such as attaching an insulating adhesive tape to the metal plate 50, coating the metal plate 50 with an insulator, and printing an insulator onto the metal plate 50. The insulating portions 60*a* and 60*b* are typically made of an epoxy resin, polyimide, or the like.

In the electrical connector 1 having the foregoing configuration, the metal plate 50 reinforces the contact support portion 12. This can prevent breakage and the like of the contact support portion 12 and improve the strength of the contact support portion 12 even if the contact support portion 12 is subjected to an external load, like when mated or unmated with/from the mating connector.

<Method for Manufacturing Electrical Connector>

A method for manufacturing the electrical connector 1 according to the first embodiment of the present invention will be described in detail below with reference to FIGS. 3A to 3D.

Figure 3A:
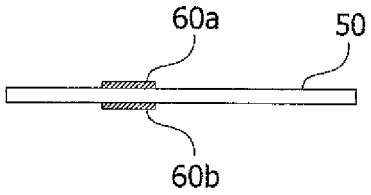
FIGS. 3A to 3D are diagrams showing a method for manufacturing the electrical connector according to one or more embodiments of the present invention.

Initially, the insulating portion 60*a* is formed in a predetermined position on the top surface of the metal plate 50. The insulating portion 60*b* is formed on the bottom surface of the metal plate 50 in the position opposite from where the insulating portion 60*a* is formed (FIG. 3A).

Figure 3B:
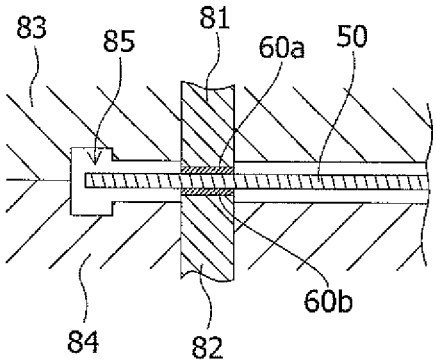

Next, the metal plate 50 is set between an upper mold 83 and a lower mold 84, and the positions where the insulating portions 60*a* and 60*b* are formed on the metal plate 50 are sandwiched between a retaining pin 81 and a retaining pin 82. In such a state, a molten resin is filled into a cavity 85 formed between the upper mold 83 and the lower mold 84 (FIG. 3B).

Figure 3C:
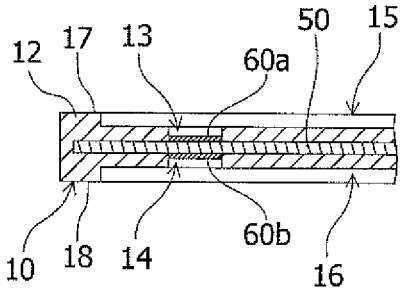

After the resin filled into the cavity 85 is cured, the retaining pin 81 is removed from the upper mold 83 and the retaining pin 82 is removed from the lower mold 84 to release the molded article (FIG. 3C). The released molded article has the hole portion 13 which is the trace of the retaining pin 81 removed and the hole portion 14 which is the trace of the retaining pin 82 removed. The bottom end of the hole portion 13 is blocked by the insulating portion 60*a* formed on the metal plate 50. The top end of the hole portion 14 is blocked by the insulating portion 60*b* formed on the metal plate 50. Recess grooves 15 are formed forward from the rear end of the outer surface 17 of the contact support portion 12. Recess grooves 16 are formed forward from the rear end of the outer surface 18 of the contact support portion 12. The hole portion 13 communicates with the recess grooves 15. The hole portion 14 communicates with the recess grooves 16.

Figure 3D:
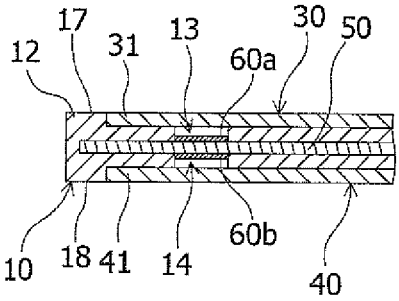

Next, the upper contacts 30 are pressed in from behind the housing 10, whereby the connection portions 31 are arranged in the recess grooves 15 of the contact support portion 12. The lower contacts 40 are pressed in from behind the housing 10, whereby the connection portions 41 are arranged in the recess grooves 16 of the contact support portion 12 (FIG. 3D). In such a state, the top end of the hole portion 13 opens to the outer surface 17 and is blocked by the connection portions 31. The bottom end of the hole portion 13 exposes the insulating portion 60*a* but not the metal plate 50. The bottom end of the hole portion 14 opens to the outer surface 18 and is blocked by the connection portions 41. The top end of the hole portion 14 exposes the insulating portion 60*b* but not the metal plate 50.

<Modification of Method for Manufacturing Electrical Connector>

Next, a modification of the method for manufacturing the electrical connector 1 according to the first embodiment of the present invention will be described in detail with reference to FIGS. 4A to 4E.

The metal plate 50 is not limited to the one fixed to the housing 10 by integral molding, and may be fixed to the housing 10 by press-in.

Figure 4A:
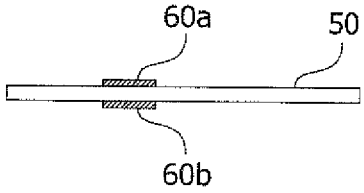
FIGS. 4A to 4E are diagrams showing a modification of the method for manufacturing the electrical connector according to one or more embodiments of the present invention.

Initially, the insulating portion 60*a* is formed in a predetermined position on the top surface of the metal plate 50. The insulating portion 60*b* is formed on the bottom surface of the metal plate 50 in the position opposite from where the insulating portion 60*a* is formed (FIG. 4A).

Figure 4B:
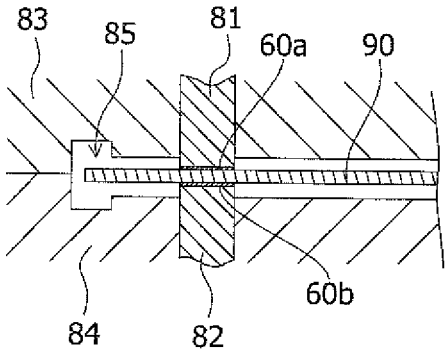

Next, a die part 90 having the same thickness, width, and shape as those of the metal plate 50 is set between the upper mold 83 and the lower mod 84. The die part 90 is sandwiched between the retaining pins 81 and 82 from above and below. In such a state, a molten resin is filled into the cavity 85 formed between the upper mold 83 and the lower mold 84 (FIG. 4B).

Figure 4C:
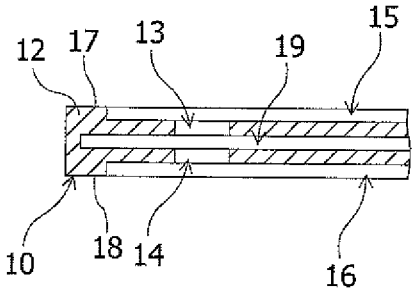

After the resin filled into the cavity 84 is cured, the retaining pin 81 is removed from the upper mold 83 and the retaining pin 82 is removed from the lower mold 84. The die part 90 is removed from the upper mold 83 and the lower mold 84 to release the molded article (FIG. 4C). The released molded article has the hole portion 13 which is the trace of the retaining pin 81 removed and the hole portion 14 which is the trace of the retaining pin 82 removed. The recess grooves 15 are formed forward from the rear end of the outer surface 17 of the contact support portion 12. The recess grooves 16 are formed forward from the rear end of the outer surface 18 of the contact support portion 12. A holding hole 19 which is the trace of the die part 90 removed is formed forward from the rear end of the contact support portion 12, between the recess grooves 15 and the recess grooves 16. The holding hole 19 is parallel to the recess grooves 15 and 16. The holding hole 19 opens to the outside at the rear end, and is extended forward from the rear end to near the front end of the contact support portion 12. The hole portion 13 and the hole portion 14 communicate with each other via the holding hole 19. The hole portion 13 communicates with the recess grooves 15. The hole portion 14 communicates with the recess grooves 16.

Figure 4D:
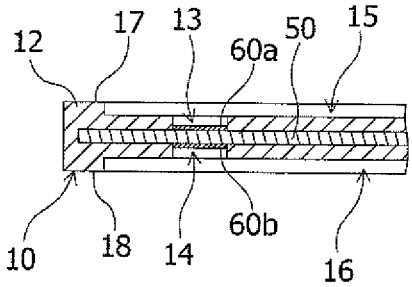

Next, the metal plate 50 is pressed into the holding hole 19 from behind and fixed to the contact support portion 12 (FIG. 4D). In such a state, the bottom end of the hole portion 13 is blocked by the insulating portion 60*a* formed on the metal plate 50. The top end of the hole portion 14 is blocked by the insulating portion 60*b* formed on the metal plate 50.

Figure 4E:
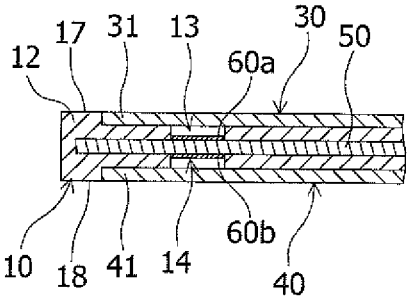

Next, the upper contacts 30 are pressed in from behind the housing 10, whereby the connection portions 31 are arranged in the recess grooves 15 of the contact support portion 12. The lower contacts 40 are pressed in from behind the housing 10, whereby the connection portions 41 are arranged in the recess grooves 16 of the contact support portion 12 (FIG. 4E). In such a state, the top end of the hole portion 13 opens to the outer surface 17 and is blocked by the connection portions 31. The bottom end of the hole portion 13 exposes the insulating portion 60*a* but not the metal plate 50. The bottom end of the hole portion 14 opens to the outer surface 18 and is blocked by the connection portions 41. The top end of the hole portion 14 exposes the insulating portion 60*b* but not the metal plate 50.

As described above, according to the present embodiment, the electrical connector 1 includes: the metal plate 50 including the insulating portions 60*a* and 60*b*; and the contact support portion 12 including the hole portion 13 that is extended in the thickness direction of the contact support portion 12, of which the top end is blocked by the connection portions 31, and of which the bottom end exposes the insulating portion 60*a* but not the metal plate 50, and the hole portion 14 that is extended in the thickness direction of the contact support portion 12, of which the bottom end is blocked by the connection portions 41, and of which the top end exposes the insulating portion 60*b* but not the metal plate 50. Consequently, the occurrence of an electrical malfunction can be prevented even if a foreign substance or liquid is interposed in the hole portion 13 and/or the hole portion 14.

According to the present embodiment, the metal plate 50 may be fixed to the contact support portion 12 by integral molding. The metal plate 50 may be fixed to the contact support portion 12 by press-in. In either case, the occurrence of an electrical malfunction can be prevented even if a foreign substance or liquid is interposed in the hole portion 13 and/or the hole portion 14 which are the traces of the retaining pins 81 and 82 removed.

According to the present embodiment, the electrical connector 1 is multipolarized by exposing the connection portions 31 in the outer surface 17 of the contact support portion 12 and exposing the connection portions 41 in the outer surface 18. Such an electrical connector 1 can be prevented from an electrical malfunction if a foreign substance or liquid is interposed in the hole portion 13 and/or the hole portion 14.

(Second Embodiment)

<Configuration of Electrical Connector>

A configuration of an electrical connector 2 according to a second embodiment of the present invention will be described in detail below with reference to FIGS. 5 and 6.

Figure 2:
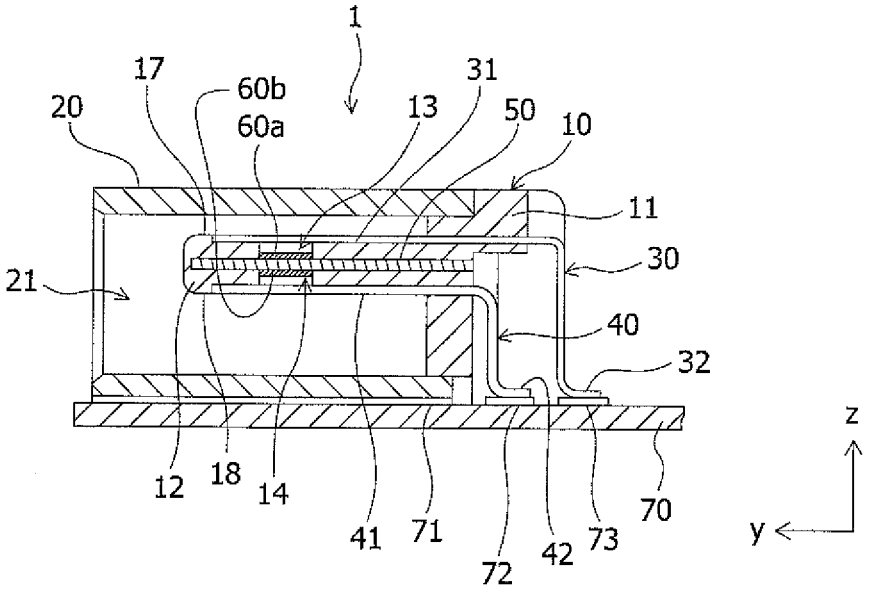
FIG. 2 is a cross-sectional view taken along the line A-A of FIG. 1.
Figure 5:
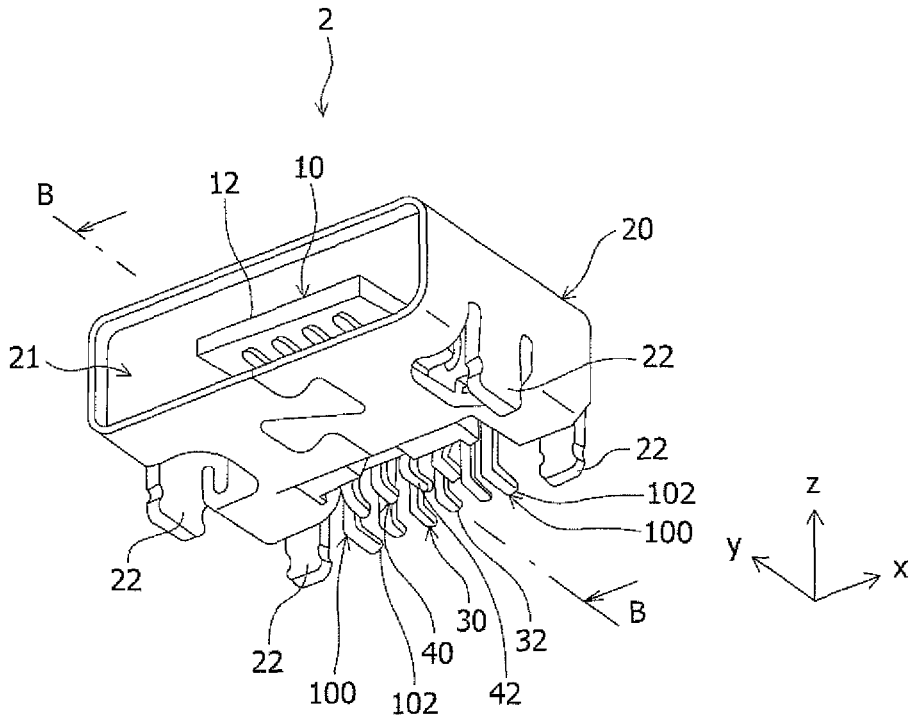
FIG. 5 is a perspective view of an electrical connector according to one or more embodiments of the present invention as seen from below, obliquely in front.
Figure 6:
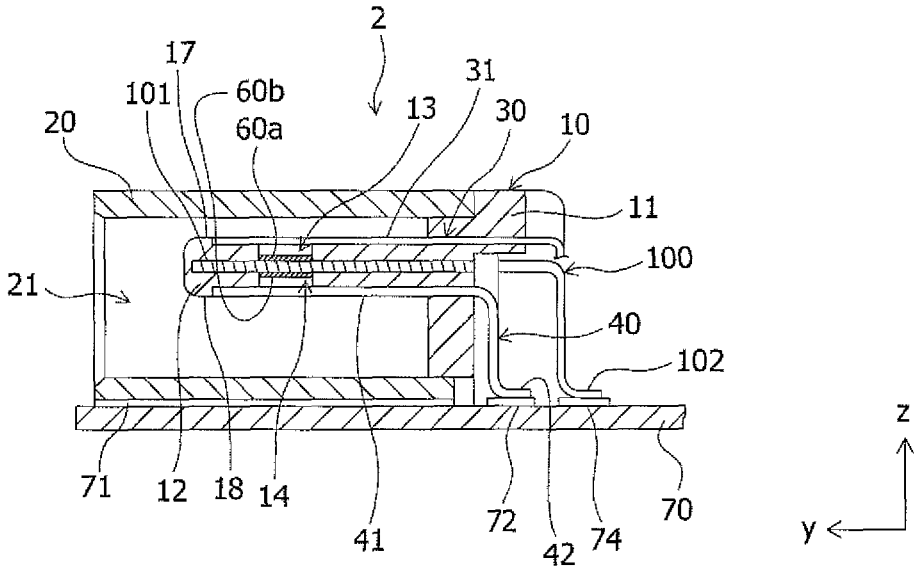
FIG. 6 is a cross-sectional view taken along the line B-B of FIG. 5.

In FIGS. 5 and 6, portions having similar configurations to those of FIGS. 1 and 2 are designated by the same reference numerals. A description thereof will be omitted.

The electrical connector 2 includes the housing 10, the shield cover 20, the upper contacts 30, the lower contacts 40, and a metal plate 100.

The metal plate 100 is fixed to the inside of the contact support portion 12. The metal plate 100 includes the insulating portion 60*a* which is exposed at the bottom end of the hole portion 13, and the insulating portion 60*b* which is exposed at the top end of the hole portion 14. The metal plate 100 includes a fixed portion 101 and leg portions 102. The fixed portion 101 is fixed to the contact support portion 12. The leg portions 102 are extended backward from respective right and left ends of the rear end, bent downward, and connected to a ground 74 of the substrate 70. The metal plate 100 functions as a shield member for shielding the connection portions 31 of the upper contacts 30 and the connection portions 41 of the lower contacts 40 from each other.

A method for manufacturing the electrical connector 2 according to the present embodiment is the same as the method for manufacturing the electrical connector 1 according to the foregoing first embodiment. A description thereof will thus be omitted.

As described above, according to the present embodiment, the metal plate 100 serves as a shielding member. This provides high shielding performance in addition to the effects of the foregoing first embodiment.

According to the present embodiment, the metal plate 100 serves as both a reinforcing member for reinforcing the strength of the contact support portion 12 and a shielding member to reduce the parts count. This can reduce manufacturing cost and enables miniaturization.

(Third Embodiment)

<Configuration of Electrical Connector>

A configuration of an electrical connector 3 according to a third embodiment of the present invention will be described in detail below with reference to FIG. 7.

Figure 7:
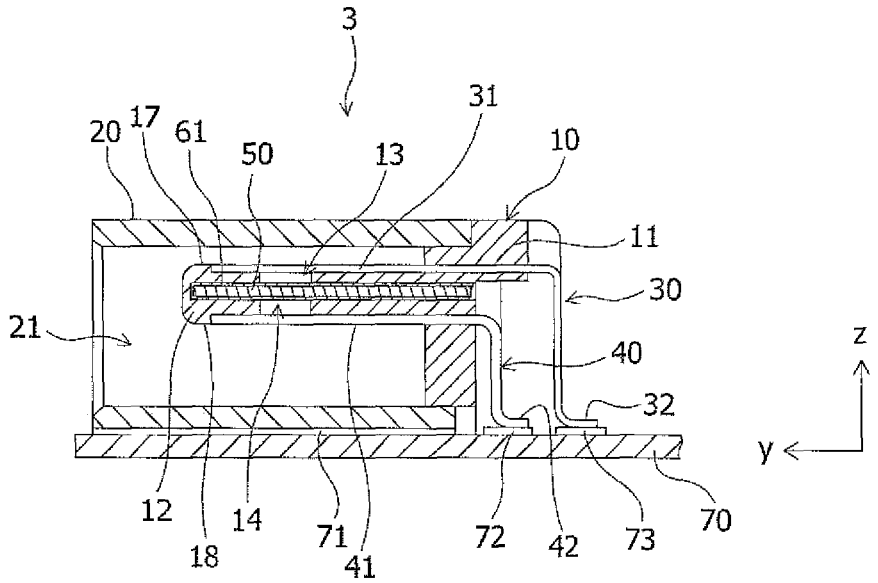
FIG. 7 is a cross-sectional view of an electrical connector according to one or more embodiments of the present invention.

In FIG. 7, portions having similar configurations to those of FIGS. 1 and 2 are designated by the same reference numerals. A description thereof will be omitted.

The electrical connector 3 includes the housing 10, the shield cover 20, the upper contacts 30, the lower contacts 40, and the metal plate 50.

The entire metal plate 50 is covered with an insulating portion 61. The metal plate 50 thus has the insulating portion 61 exposed at the bottom end of the hole portion 13 and at the top end of the hole portion 14. In other respects, the metal plate 50 has the same configuration as that of the metal plate 50 according to the foregoing first embodiment. A description thereof will thus be omitted.

A method for manufacturing the electrical connector 3 according to the present embodiment is the same as the method for manufacturing the electrical connector 1 according to the foregoing first embodiment except that the entire metal plate 50 is covered with the insulating portion 61. A description thereof will thus be omitted.

As described above, according to the present embodiment, the entire metal plate 50 is covered with the insulating portion 61. When fixing the metal plate 50 to the contact support portion 12, complicated positioning to position insulating portions to the hole portions 13 and 14 is therefore not needed. This allows easy manufacturing in addition to the effects of the foregoing first embodiment.

According to the present embodiment, when forming the insulating portion 61 on the metal plate 50, the insulating portion 61 does not need to be positioned to the metal plate 50. This allows easy manufacturing.

According to the present embodiment, the entire metal plate 50 is covered with the insulating portion 61. This can prevent adhesion of liquid and the like to the metal plate 50 in manufacturing and other processes, and can reduce erosion of the metal plate 50.

In the present embodiment, the metal plate 50 is covered with the insulating portion 51. Instead, a metal plate member may entirely be covered with the insulating portion 61 in advance, and the plate member entirely covered with the insulating portion 61 may be cut to form the metal plate 50. In such a case, the metal plate 50 does not have the insulating portion 61 on its cut sections. Since the insulating portion of the metal plate 50 can block at least the bottom end of the hole portion 13 and the top end of the hole portion 14, the occurrence of an electrical malfunction can be prevented even if a foreign substance or liquid is interposed in the hole portion 13 and/or the hole portion 14.

If the insulating portion 61 is formed on the metal plate 50 by the foregoing method, additional insulating portions may be formed on the cut sections of the metal plate 50 that is formed by cutting the plate material on which the insulating portion 61 is formed. This can prevent adhesion of liquid and the like to the metal plate 50 in the manufacturing and other processes, and can reduce erosion of the metal plate 50.

(Fourth Embodiment)

<Configuration of Electrical Connector>

A configuration of an electrical connector 4 according to a fourth embodiment of the present invention will be described in detail below with reference to FIG. 8.

Figure 8:
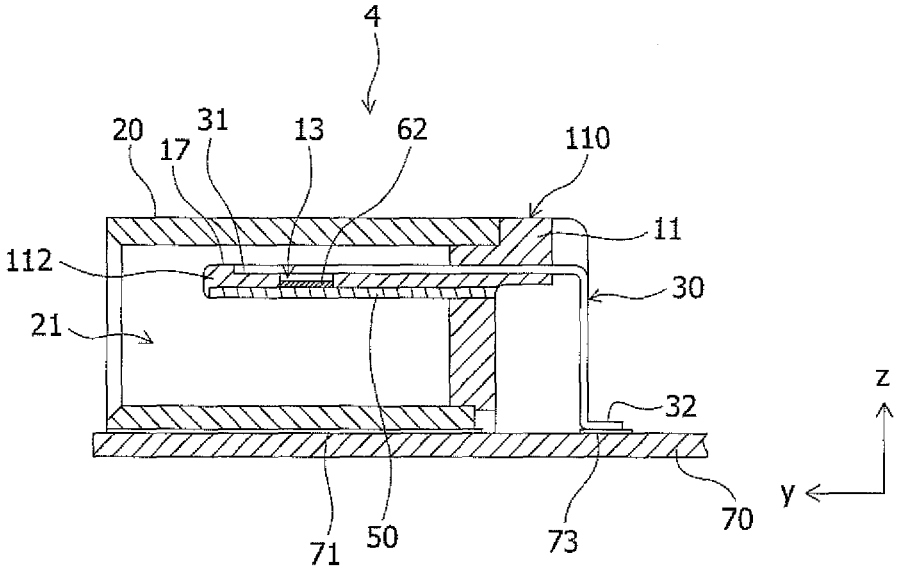
FIG. 8 is a cross-sectional view of an electrical connector according to one or more embodiments of the present invention.

In FIG. 8, portions having similar configurations to those of FIGS. 1 and 2 are designated by the same reference numerals. A description thereof will be omitted.

The electrical connector 4 includes the shield cover 20, the upper contacts 30, the metal plate 50, and a housing 110.

The housing 110 is made of an insulating material. The hosing 110 includes a contact support portion 112 of plate shape that is extended forward from a rear wall 11. The contact support portion 112 includes a hole portion 13 which is extended in a vertical direction. The top end of the hole portion 13 opens to an outer surface 17 and is blocked by the connection portions 31. The bottom end of the hole portion 13 exposes an insulating portion 62 but not the metal plate 50. The connection portions 31 and the insulating portion 62 are opposed to each other via the hole portion 13.

The metal plate 50 is exposed in an outer surface 18 of the contact support portion 112. The metal plate 50 includes the insulating portion 62 which is exposed at the bottom end of the hole portion 13. A method for forming the insulating portion 62 on the metal plate 50 and the material of the insulating portion 62 are the same as those of the insulating portions 60*a* and 60*b* according to the foregoing first embodiment. A description thereof will thus be omitted.

A method for manufacturing the electrical connector 4 according to the present embodiment is the same as the method for manufacturing the electrical connector 1 according to the foregoing first embodiment except that the electrical connector 4 does not include the lower contacts 40 and that the contact support portion 112 does not have the portions for holding the lower contacts 40. A description thereof will thus be omitted.

According to the present embodiment, the electrical connector 4 is configured to include the upper contacts 30 and the metal plate 50 that is exposed in the outer surface 18 of the contact support portion 112 opposite from the outer surface 17 where the upper contacts 30 are exposed. The occurrence of an electrical malfunction of such an electrical connector can be prevented even if a foreign substance or liquid is interposed in the hole portion 13.

According to the present embodiment, the metal plate 50 may be fixed to the housing 110 by integral molding. The metal plate 50 may be fixed to the housing 110 by press-in. In either case, the occurrence of an electrical malfunction can be prevented even if a foreign substance or liquid is interposed in the hole portion 13 which is the trace of the retaining pin 81 removed.

In the present embodiment, the connection portions 31 of the upper contacts 30 are exposed in the outer surface 17 of the contact support portion 112, and the metal plate 50 is exposed in the outer surface 18 of the contact support portion 112. Instead, the metal plate 50 may be exposed in the outer surface 17 of the contact support portion 112, and the connection portions 41 of the lower contacts 40 may be exposed in the outer surface 18 of the contact support portion 112.

(Fifth Embodiment)

<Configuration of Electrical Connector>

A configuration of an electrical connector 5 according to a fifth embodiment of the present invention will be described in detail below with reference to FIG. 9.

Figure 9:
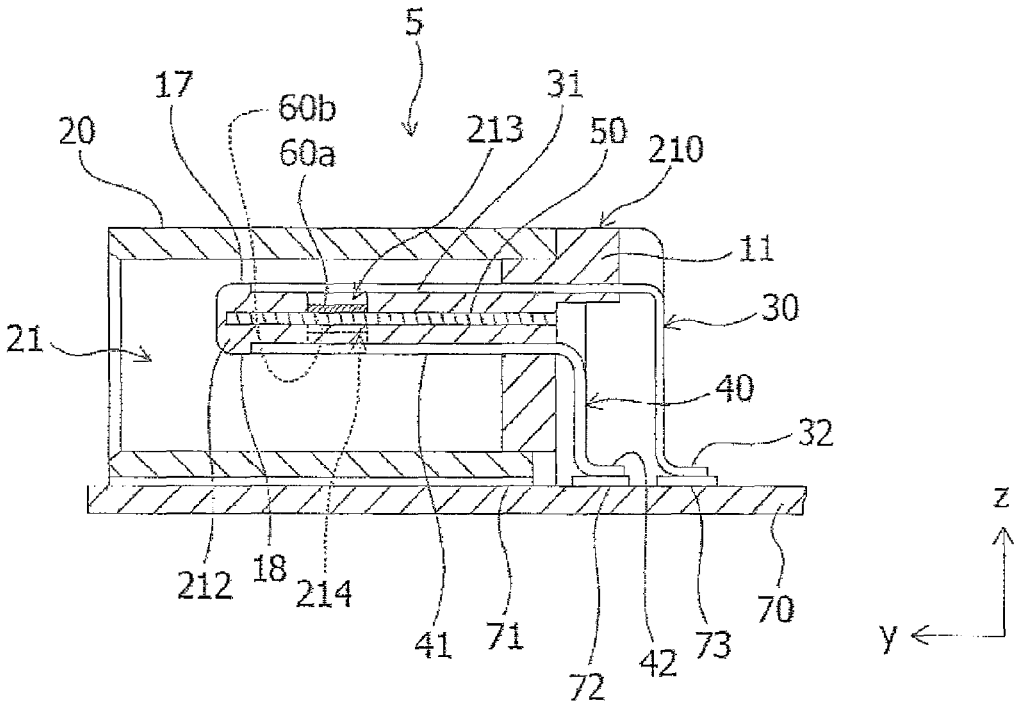
FIG. 9 is a cross-sectional view of an electrical apparatus according to one or more embodiments of the present invention.

In FIG. 9, portions having similar configurations to those of FIGS. 1 and 2 are designated by the same reference numerals. A description thereof will be omitted.

The electrical connector 5 includes the shield cover 20, the upper contacts 30, the lower contacts 40, the metal plate 50, and a housing 210.

The housing 210 is made of an insulating material. The housing 210 includes a contact support portion 212 of plate shape that is extended forward from a rear wall 11. The contact support portion 212 fits to a not-shown mating connector. The contact support portion 212 includes a hole portion 213 and a hole portion 214. The hole portion 213 is extended in a vertical direction. The top end of the hole portion 213 opens to an outer surface 17 and is blocked by the connection portions 31. The bottom end of the hole portion 213 exposes the insulating portion 60*a* but not the metal plate 50. The hole portion 214 is extended in the vertical direction. The bottom end of the hole portion 214 opens to an outer surface 18 and is blocked by the connection portions 41. The top end of the hole portion 214 exposes the insulating portion 60*b* but not the metal plate 50. The connection portions 31 and the insulating portion 60*a* are opposed to each other via the hole portion 213. The connection portions 41 and the insulating portion 60*b* are opposed to each other via the hole portion 214. The hole portion 214 is arranged in a position off the hole portion 213.

The plurality of upper contacts 30 are made of a conductive material in a narrow plate shape each, and fixed to the housing 210. The upper contacts 30 each include a connection portion 31 and a terminal portion 32. The connection portions 31 are exposed in the outer surface 17 of the contact support portion 212 and supported by the contact support portion 212, and block the top end of the hole portion 213 opened in the outer surface 17. The terminal portions 32 are protruded outward and backward from the rear wall 11, bent downward, and connected to the conductive portions 73 of the substrate 70. The connection portions 31 are arranged along the protruding direction of the contact support portion 212.

The plurality of lower contacts 40 are made of a conductive material in a narrow plate shape each, and fixed to the housing 210. The lower contacts 40 each include a connection portion 41 and a terminal portion 42. The connection portions 41 are exposed in the lower outer surface 18 of the contact support portion 212 and supported by the contact support portion 212, and block the bottom end of the hole portion 214 opened in the outer surface 18. The terminal portions 42 are protruded outward and backward from the rear wall 11, bent downward, and connected to the conductive portions 72 of the substrate 70. The connection portions 41 are arranged along the protruding direction of the contact support portion 212.

The metal plate 50 is fixed to the inside of the contact support portion 212, and arranged between the upper contacts 30 and the lower contacts 40. The metal plate 50 is arranged to be separated from the upper contacts 30 and the lower contacts 40 in a thickness direction of the contact support portion 212. The metal plate 50 includes the insulating portion 60*a* which is exposed at the bottom end of the hole portion 213, and the insulating portion 60*b* which is exposed at the top end of the hole portion 214.

The types, arrangement, numbers, and the like of the members according to the present invention are not limited to the foregoing embodiments. It will be understood that appropriate modifications may be made without departing from the gist of the invention. For example, the components may be appropriately replaced with ones having similar operations and effects.

For example, in the foregoing first to fifth embodiments, the electrical connector includes a shield cover. Without the provision of the shield cover, the contact support portion may be surrounded by a housing having an insertion hole into which the mating connector can be inserted.

In the foregoing first to fifth embodiments, the insulating portion(s) is/are formed on the metal plate. However, insulating portions may be formed on the connection portions of the contacts so that the insulating portions formed on the connection portions of the contacts block either one of the vertical ends of a hole portion. The metal plate may block the other of the vertical ends of the hole portion.

In the foregoing first to fifth embodiments, the front end of the metal plate is arranged inside the contact support portion. However, the front end of the metal plate may be protruded forward from the front end of the contact support portion.

In the foregoing first to fifth embodiments, the hole portions are the traces of the retaining pins removed. However, the hole portions may be a space occurring from any reason between the connection portions of the contacts and the metal plate, and do not necessarily be the traces of the retaining pins removed.

The present invention is suitable for an electrical connector including an insulating housing in which a contact support portion of plate shape that supports a contact and is mated and unmated with a mating connector is included.

1 electrical connector
2 electrical connector
3 electrical connector
4 electrical connector
5 electrical connector
10 housing
11 rear wall
12 contact support portion
13 hole portion
14 hole portion
15 recess groove
16 recess groove
17 outer surface
18 outer surface
19 holding hole
20 shield cover
21 insertion hole
22 terminal portion
30 upper contact
31 connection portion
32 terminal portion
40 lower contact
41 connection portion
42 terminal portion
50 metal plate
60*a* insulating portion
60*b* insulating portion
70 substrate
71 ground
72 conductive portion
73 conductive portion
81 retaining pin
82 retaining pin
83 upper mold
84 lower mold
85 cavity
90 die part
100 metal plate
101 fixed portion
102 terminal portion
110 housing
112 contact support portion
113 hole portion
210 housing
212 contact support portion
213 hole portion
214 hole portion While the invention has been described with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

The invention claimed is:

1. An electrical connector comprising:

an insulating housing comprising a rear wall and a contact support portion that extends forward from the rear wall and fits to a mating connector, wherein the contact support portion is plate-shaped;

a conductive contact comprising a connection portion arranged on an outer surface of the contact support portion and a terminal portion connected to a conductive portion of a substrate, the conductive contact is held by the housing; and a metal plate that is fixed to the contact support portion so as to be separated from the connection portion in a thickness direction of the contact support portion, wherein the metal plate comprises an insulating portion, and wherein the contact support portion comprises a hole portion that extends in the thickness direction, of which one of ends in the thickness direction is blocked by the connection portion, and of which the other end in the thickness direction exposes the insulating portion but not the metal plate.

2. The electrical connector according to claim 1, wherein:

the contact comprises a first contact and a second contact, the first contact comprises the connection portion arranged on a first outer surface of the contact support portion, the second contact comprises the connection portion arranged on a second outer surface of the contact support portion opposite from the first outer surface;

the metal plate is arranged between the connection portion of the first contact and the connection portion of the second contact, and the hole portion comprises a first hole portion of which one end opens to the first outer surface and is blocked by the connection portion of the first contact and of which the other end exposes the insulating portion but not the metal plate, and a second hole portion of which one end opens to the second outer surface and is blocked by the connection portion of the second contact and of which the other end exposes the insulating portion but not the metal plate.

3. The electrical connector according to claim 1, wherein:

the contact comprises the connection portion arranged on a first outer surface of the contact support portion, the metal plate is arranged between the first outer surface and a second outer surface of the contact support portion opposite from the first outer surface, and the one end of the hole portion opens to the first outer surface and is blocked by the connection portion, and the other end of the hole portion exposes the insulating portion and not the metal plate.

4. The electrical connector according to claim 1, wherein:

the contact comprises the connection portion arranged on a first outer surface of the contact support portion, the metal plate is arranged on a second outer surface of the contact support portion opposite from the first outer surface, and the one end of the hole portion opens to the first outer surface and is blocked by the connection portion, and the other end of the hole portion exposes the insulating portion but not the metal plate.

5. The electrical connector according to claim 1, wherein the metal plate is entirely covered with the insulating portion.

6. The electrical connector according to claim 1, wherein the metal plate comprises a leg portion connected to a ground of the substrate and functions as a shield member.

7. The electrical connector according to claim 1, wherein:

the housing is integrally molded by filling a resin into a cavity of a mold in which the metal plate is set, the metal plate is fixed to the contact support portion; and the hole portion is a trace of removing a retaining pin for sandwiching and holding the metal plate on the mold during an integral molding.

8. The electrical connector according to claim 1, wherein:

the contact support portion comprises a holding hole of which a rear end opens to outside and that is extended forward from the rear end, the metal plate is pressed into the holding hole and fixed to the contact support portion, the holding hole is a trace of a die part removed after filling a resin into a cavity of a mold in which the die part is set and curing the resin, the die part having the same shape as that of the metal plate, and the hole portion is a trace of removal of a retaining pin for sandwiching and holding the die part on the mold during the filling of the resin into the cavity.

* * * * *